US005241768A

United States Patent [19]

Thompson

[11] Patent Number: 5,241,768

[45] Date of Patent: Sep. 7, 1993

[54] MESSAGE HOLDER

[76] Inventor: James A. Thompson, 4700 Stancliffe Ct., Bakersfield, Calif. 93307

[21] Appl. No.: 845,726

[22] Filed: Mar. 4, 1992

[51] Int. Cl.[5] ..... G09F 3/18

[52] U.S. Cl. ..... 40/661; 40/597; 40/593

[58] Field of Search ..... 40/642, 649, 661, 597, 40/643, 591, 593, 651, 606, 607; 248/206.3, 467; 224/277

[56] References Cited

U.S. PATENT DOCUMENTS

| | | | |
|---|---|---|---|
| D. 304,737 | 11/1989 | Mori | D20/42 |
| 519,256 | 5/1894 | Greene | 40/651 |
| 1,175,652 | 3/1916 | Marquette | 40/649 |
| 1,835,980 | 12/1931 | Hallowell | 40/606 |
| 1,856,519 | 5/1932 | Spears . | |
| 2,880,535 | 4/1959 | Bryant . | |
| 3,533,178 | 10/1970 | Strohmaier . | |
| 3,936,967 | 2/1976 | Davis | 40/597 X |
| 4,248,001 | 2/1981 | Feuvray | 40/606 X |
| 4,953,315 | 9/1990 | Romaine | 40/593 |
| 4,955,153 | 9/1990 | Albrecht et al. | 40/661 |

FOREIGN PATENT DOCUMENTS

| | | | |
|---|---|---|---|
| 2650104 | 1/1991 | France | 40/593 |
| 1138865 | 1/1969 | United Kingdom | 248/467 |

*Primary Examiner*—Kenneth J. Dorner
*Assistant Examiner*—J. Bonifanti
*Attorney, Agent, or Firm*—Richard C. Litman

[57] ABSTRACT

A message holder for use in vehicles or home or other building windows or the like provides for the display of a message inserted therein. The holder is formed of at least one sheet of transparent material and contains a central space in which a message, such as a bumper sticker, may be temporarily installed for display. Suspension rods are pivotally attached to opposite ends of the holder and have suction cups to provide for the attachment of the holder to any suitable surface. The suspension rods may be locked at any desired angle in order to allow a message displayed within the holder to be seen clearly even through a sloped window, as in the rear window of many vehicles. The holder provides for the temporary display of a bumper sticker or other message as desired without the need to adhesively secure the sticker to a surface and the resulting difficulty of subsequent removal and possible marring of the finish. An alternative version includes suction cups on attachment lugs extending from each end of the holder.

7 Claims, 2 Drawing Sheets

MESSAGE HOLDER

FIELD OF THE INVENTION

This invention relates generally to holders for the display of printed messages and the like, and more specifically to a device for the temporary display of messages such as those found on bumper stickers and the like and intended primarily for use in motor vehicles.

BACKGROUND OF THE INVENTION

More and more motorists have taken to displaying various messages on their automobiles, using short preprinted phrases or sentences to describe everything from political and religious preferences to favorite sports teams, radio stations, and opinions relating to driving habits and a myriad of other subjects. One nearly universal characteristic of such preprinted messages is their attachment means, in which a protective backing sheet is removed to expose an adhesive layer on the back of the message and the message is then adhesively applied to some portion of the vehicle, generally the rear bumper. Due to their usual position as installed on the vehicle, as well as the usual attachment means, these messages have become universally known as "bumper stickers."

It will be appreciated that for various reasons, from time to time a message on a bumper sticker adhered to some portion of a vehicle may no longer reflect the opinion or feelings of the vehicle operator. For example, local radio stations often run contests which require a vehicle to display a message advertising that particular station. When such a contest ends, the vehicle operator may no longer wish to advertise that particular station by means of a message on his or her vehicle.

The adhesives generally used on the backs of such bumper stickers are quite tenacious, and can prove to be very difficult to remove completely when the bumper sticker deteriorates and/or the operator of the vehicle wishes to remove it for whatever reason. Moreover, the area of the vehicle which was covered by the bumper sticker will generally age at a different rate than the surrounding area exposed to the weather and sun and accompanying ultraviolet radiation, resulting in a different (generally darker) shade for the finish which was protected by the bumper sticker even when the sticker and residue are completely removed.

The need arises for a holder for such vehicle message signs, which holder permits the display of such message signs without requirement for adhesive attachment to any portion of the vehicle or holder. The holder itself must be readily portable and attachable and removable from the vehicle without damage to the vehicle finish, and moreover permit ease of installation and removal for any messages displayed therein. The holder should also allow positional and angular adjustment in order to optimally display any message installed therein.

DESCRIPTION OF THE RELATED ART

U.S. Pat. No. 1,856,519 issued to a. C. Spears on May 3, 1932 discloses an Identification Name Plate for use in vehicles. The device includes a back light to display the name or message at night, and the message itself must be specially manufactured in order to take advantage of the backlighting provided by the device. The message is not readily removable and replaceable with a different message, as in the case of the present invention.

U.S. Pat. No. 2,880,535 issued to E. V. Bryant on Apr. 7, 1959 discloses a Safety Emblem. The device comprises two lateral extensions attachable to either side of a standard license plate. As in the case of the Spears patent discussed above, the message is not readily removable or replaceable, nor is any means disclosed for the display of a standard, readily available message such as a bumper sticker.

U.S. Pat. No. 3,533,178 issued to G. F. Strohmaier on Oct. 13, 1970 discloses a Holder For Vehicle Registration Certificate. The construction and attachment means of the device are unlike that of the present invention, and the size, position in the vehicle, and function are unrelated.

U.S. Pat. No. 4,953,315 issued to R. A. Romaine on Sep. 4, 1990 discloses a display Device For vehicles. The device is attachable to the glass area of a vehicle by means of suction cups. However, the device requires a specially constructed message, only a part of which is readable at any one time. Motion of the vehicle causes the message to slide from end to end of the holder, thus displaying alternating or variable messages, unlike the present invention. Moreover, the device is not readily adaptable to glass areas which are sloped toward the horizontal to any great degree.

U.S. Pat. No. 4,955,153 issued to L. N. Albrecht et al. on Sep. 11, 1990 discloses a Display Sign Holder And Display Sign Therefor comprising a single sheet of material which is installed to be spaced apart from the vehicle glass by means of adhesive attachment means on opposite sides of the sheet. A message may be inserted between the sheet and the spaced apart glass. No means is disclosed to prevent the message from sliding from one or the other end of the holder due to motion of the vehicle.

Finally, U.S. Pat. No. D-304,737 issued to E. Y. Mori on Nov. 21, 1989 discloses a Sign For An Automobile Window. The design discloses what appear to be oppositely positioned suction cups on a message board. The message appears to be integral with the design, and therefore no means is disclosed for changing the message other than to provide a new design.

None of the above noted patents, either singly or in combination, are seen to disclose the specific arrangement of concepts disclosed by the present invention.

SUMMARY OF THE INVENTION

By the present invention, an improved holder for the display of messages is disclosed.

Accordingly, one of the objects of the present invention is to provide an improved message holder for the display of messages such as bumper stickers and the like.

Another of the objects of the present invention is to provide an improved message holder which may be temporarily secured to and easily removed from a surface without the need for adhesive substances.

Yet another of the objects of the present invention is to provide an improved message holder which allows a message to be temporarily inserted therein and easily removed therefrom without need for adhesive attachement of the message to the holder.

Still another of the objects of the present invention is to provide an improved message holder which may be secured to the interior of a vehicle window, thereby protecting both the holder and the message from damage or loss.

A further object of the present invention is to provide an improved message holder which may be adjusted to allow for other than vertical attachment surfaces.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
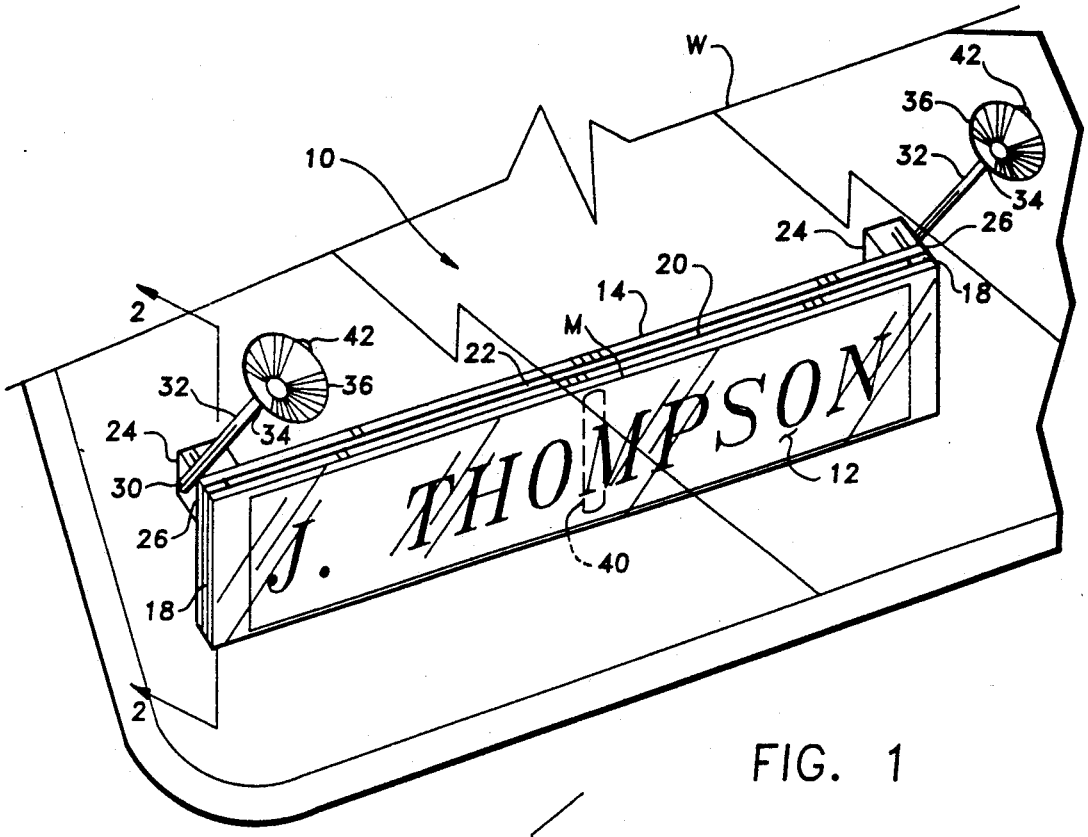
FIG. 1 is a perspective view of the message holder of the present invention, showing many of its various features as they would apply to its use.

Referring now to the drawings, particularly FIG. 1 of the drawings, the present invention will be seen to relate to a message holder 10 for the display of messages in a vehicle. Holder 10 will be seen to be attachable to a window W of virtually any vehicle. It is envisioned that holder 10 will prove most valuable for the display of messages as found on the typical bumper sticker, and is preferably sized and shaped accordingly. as such bumper stickers are typically displayed on the rear of a vehicle, holder 10 would likely find its greatest use attached to the inner surface I of a vehicle rear window for the rearward display of any message inserted therein. However, holder 10 may obviously be applied to any window surface, whether inner or outer as appropriate, on virtually any apparatus from household or other building window glass to automobiles, boats, aircraft, etc. Holder 10 is not limited to use on glass surfaces, as are some other devices due to the nature of their adhesives, but may be applied to virtually any clear, translucent or even opaque surface as desired.

Figure 2:
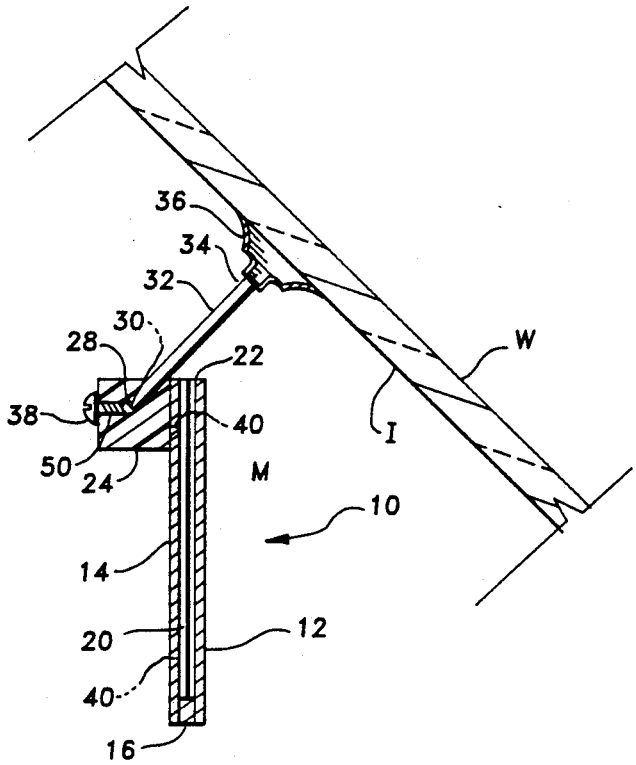
FIG. 2 is a side view in section along line 2—2 of FIG. 1.

The basic structure of holder 10 is most clearly shown in FIG. 2. Holder 10 will be seen to be formed of a first transparent planar sheet 12, which sheet 12 is held in a parallel but spaced apart relationship to a second planar sheet 14 by means of a bottom medial spacer 16 and two opposite end medial spacers 18. First and second sheets 12 and 14 are preferably formed of a clear, transparent material such as an acrylic plastic, but other materials may be used. Insofar as the function of holder 10 is concerned, it is only necessary that first sheet 12 be formed of a clear and transparent material; this is the only surface which provides for display of a message contained by holder 10. However, in the event that no message or other opaque material is carried by holder 10, it may be preferable to form both first sheet 12 and second sheet 14 from clear and transparent materials in order that the operator of the vehicle will be better able to see through holder 10. Materials such as clear acrylic plastics are relatively easy to work with, and components 12, 14, 16 and 18 of holder 10 may all be formed of such an acrylic material if desired.

First sheet 12, second sheet 14, bottom spacer 16, and end spacers 18 will be seen to define a central message space 20, which space 20 is accessible by means of the open upper edge 22 between first and second sheets 12 and 14. Open upper edge 22 will be seen to extend completely between end spacers 18, to provide an opening equal in width to that of central space 20.

Means for securing message holder 10 to a surface are provided by left and right attachment blocks 24, which blocks 24 may be formed of a clear acrylic material in the manner of other components of holder 10, or any other suitable material. Blocks 24 are preferably secured to the oppositely spaced upper corners 26 of second sheet 14, in order to preclude any obscuration of any message M which may be contained within space 20 of holder 10. Blocks 24 include lateral passages 28 which provide securing means for the pivotal ends 30 of L-shaped suspension rods 32 inserted therein. Suspension rods 32 each have an attachment end 34 which includes a suction cup 36, which cups 36 provide for the temporary and easily removable attachment of message holder 10 to a surface.

Message holder 10 provides for the display of any suitable message M, such as a bumper sticker or the like, without the need to use any adhesive attachment means as commonly included with such stickers and the accompanying disadvantages relating to difficulty of removal and possible damage to the underlying surface. Any message M desired to be displayed may be inserted within message space 20 by means of open upper edge 22, with the side of message M containing the message positioned so as to be visible through transparent first sheet 12. Holder 10 may be installed upon any appropriate surface, such as vehicle window glass W as shown. If window glass W has a slope varying considerably from the vertical, as shown in FIG. 2 and found in many vehicles, ends 30 of attachment rods 32 may be pivoted to any angle desired within passage 28 of blocks 24 and set screws 38 in threaded bores 50 intersecting said passage 28 may be tightened in order to lock holder 10 at the desired angle relative to window W for the optimum display of message M. Once holder 10 has been installed in a given window W by means of suction cups 36 and locked in position by means of set screws 38, no further action is required of the user.

Figure 3:
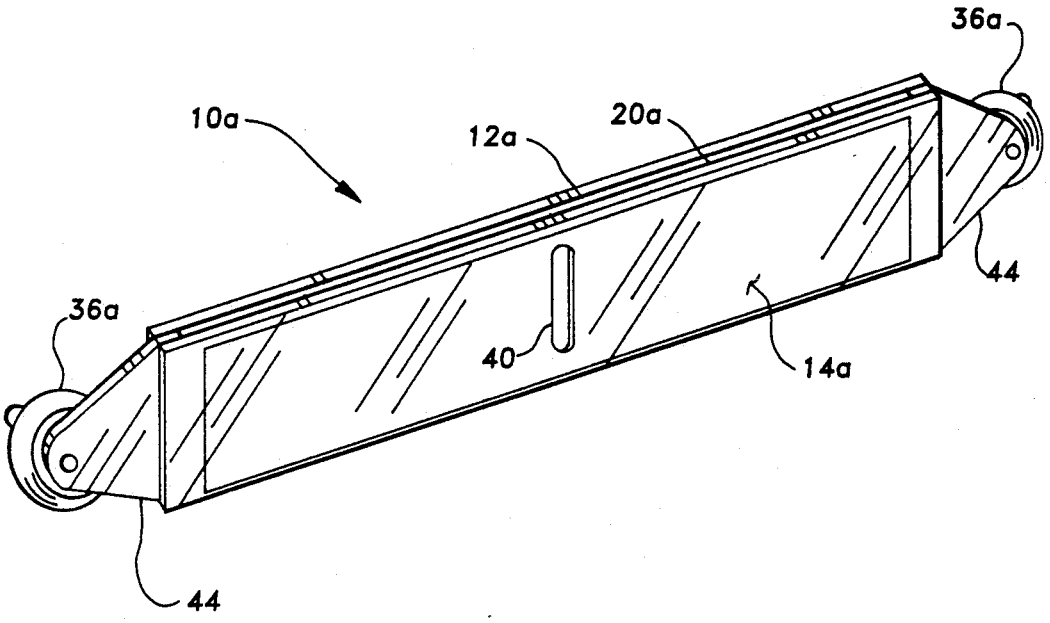
FIG. 3 is a perspective view of the opposite face of the holder, showing further details and an alternate attachment means.

As noted above, holder 10 provides for the easy removal of any message M contained therein, should such removal be desired. FIG. 3 discloses a central vertical slot 40 also shown in FIG. 1, which slot 40 provides for the insertion of a tool, fingernail, etc. through second sheet 14, 14*a* in order to urge any message M contained within holder 10 upward through open upper edge 22 for removal. Thus, any message M fitting within the central message space 20 of holder 10 may be easily and conveniently displayed without the need to adhere the message M to any surface, and may be easily changed as desired. In the event of an extremely sloped window W, set screws 38 may be loosened as required and holder 10 pivoted as necessary to allow the insertion or removal of any message M contained therein, without the need for removal of holder 10 from any surface to which it may be attached by means of suction cups 36. Alternatively, suction cups 36 may be removed from any window W or other surface to which they may be attached, rather than altering the adjustment of set screws 38. Removal tabs 42 on each suction cup 36 provide for ease of removal of cups 36.

As an alternative to the securing means provided by suspension rods 32 of holder 10, attachment lugs 44 may be used to secure suction cups 36*a* to holder 10*a* as shown in the embodiment of FIG. 3. Attachment lugs 44 are sandwiched between first and second sheets 12*a* and 14*a*, in the manner of lateral end spacers 18 described above for holder 10, and serve the same function of providing a central message space 20*a* in addition to providing attachment for suction cups 36*a* at each end of holder 10*a*. It will be seen that suction cups 36*a* will secure holder 10*a* to a surface essentially parallel to the major plane of holder 10*a*, thus any message M contained therein will be essentially parallel to the surface, such as window W, to which holder 10*a* may be attached. While this may preclude ready legibility of any message M contained therein under certain conditions of the slope of a window W and/or the angle of the prevailing light, the construction of the holder 10*a* of FIG. 3 will be seen to provide a suitable construction for use in many circumstances, such as relatively vertical window glass as found in many pickup type vehicles, windows typically found in the home and other structures, as well as opaque vertical surfaces such as walls, partitions and the like. A holder 10 or 10*a* may be secured to such opaque surfaces equally as well as to a window W, and a message M held therein may be reversed as required to face outward assuming that both first and second sheets 12, 12*a* and 14, 14*a* are transparent.

It is to be understood that the present invention is not limited to the sole embodiment described above, but encompasses any and all embodiments within the scope of the following claims.

I claim:

1. A message holder for the removable installation and temporary display of messages, comprising:

a first transparent planar sheet and a second planar sheet, said second planar sheet disposed in a plane parallel to said first transparent planar sheet and spaced apart therefrom by a bottom spacer and two opposite end spacers, said first transparent planar sheet, said second planar sheet, said bottom spacer and said two opposite end spacers defining a central message space, said second planar sheet having opposite upper corners each including an attachment block secured thereto, each said attachment block having a lateral passage formed therein with each said lateral passage having a pivotal end of a suspension rod inserted therein, each said attachment block including a set screw disposed in a threaded bore which intersects the respective lateral passage, whereby each said suspension rod pivotal end is fictionally secured within said respective block lateral passage by means of said respective set screw to pivotally secure said message holder relative to each said suspension rod, each said suspension rod further having an opposite attachment end including means for the attachment of said message holder to a surface, whereby said message holder is attached to a surface and a message is inserted within said central message space with said message visible through said first transparent planar sheet to provide for the display of said message.

2. The message holder of claim 1 wherein;

said second planar sheet is transparent.

3. The message holder of claim 1 wherein;

said first transparent planar sheet, said second planar sheet, said bottom spacer, said opposite end spacers, and said attachment blocks are formed of transparent acrylic material.

4. The message holder of claim 1 wherein;

said message comprises a bumper sticker.

5. The message holder of claim 1 including;

a slot disposed within said second planar sheet and passing completely therethrough, whereby access is provided for the removal of said message from said central message space.

6. The message holder of claim 1 wherein;

said means for the attachment of said message holder to a surface comprise suction cups disposed upon said attachment ends of said suspension rods.

7. The message holder of claim 6 including;

removal tabs disposed upon said suction cups.

* * * * *